US006231138B1

(12) United States Patent
Janson

(10) Patent No.: US 6,231,138 B1
(45) **Date of Patent: *May 15, 2001**

(54) CANTILEVERED PULL-OUT SHELF SYSTEM

(75) Inventor: Steven L. Janson, Deerfield, WI (US)

(73) Assignee: Spacesaver Corporation, Fort Atkinson, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/265,735

(22) Filed: Mar. 10, 1999

(51) Int. Cl.[7] ..... A47B 53/02
(52) U.S. Cl. ..... 312/201; 312/334.33
(58) Field of Search ..... 312/201, 198, 312/334.27, 334.32, 334.33, 334.23, 334.24

(56) References Cited

U.S. PATENT DOCUMENTS

| | | | | |
|---|---|---|---|---|
| 1,321,167 | * | 11/1919 | Voigt | 312/334.33 X |
| 2,162,318 | * | 6/1939 | Schmitz | 312/334.33 |
| 2,684,277 | | 7/1954 | Hamacher . | |

(List continued on next page.)

FOREIGN PATENT DOCUMENTS

| | | |
|---|---|---|
| 0045812 | 2/1982 | (EP) . |
| 1202484 | 8/1970 | (GB) . |
| 2051560 | 1/1981 | (GB) . |
| 2183147 | 6/1987 | (GB) . |
| 2194781 | 3/1988 | (GB) . |
| 2225928 | 6/1990 | (GB) . |
| WO 85/00733 | 2/1985 | (WO) . |

OTHER PUBLICATIONS

Ultrastor High Density Storage Brochure, Stewart Systems, P.O. Box 680625, Franklin, TN 37068, undated.

*Primary Examiner*—Peter M. Cuomo
*Assistant Examiner*—Hanh V. Tran
(74) *Attorney, Agent, or Firm*—Andrus, Sceales, Starke & Sawall, LLP

(57) ABSTRACT

An extension and retraction system for an article of furniture, such as a storage unit, includes a mounting structure for securement to the storage unit, a base arrangement for mounting to a floor or other supporting surface, and a cantilever-type extension and retraction arrangement interposed between the mounting structure and the base arrangement. The extension and retraction arrangement is in the form of a plurality of slide assemblies, each of which includes a stationary inner guide member mounted to the base arrangement mounted to each stationary guide member for telescoping inward and outward movement. Each extension member is connected to the mounting structure, and exertion of a pull-out or push-in force on the article of furniture is transferred through the mounting structure to cause extension and retraction of the extension members, to provide movement of the article of furniture between an extended position and a retracted position. The extension and retraction system is particularly well suited for applications such as high density shelving or storage, in which a number of similarly constructed units are assembled in a closely spaced relationship, such that movement of one of the units to an extended position provides access to the contents of the unit. The number of slide assemblies may be varied according to the load requirements for the article of furniture, to provide flexibility in manufacture and installation while maintaining the same basic design for the extension and retraction system.

33 Claims, 10 Drawing Sheets

U.S. PATENT DOCUMENTS

| | | | |
|---|---|---|---|
| 3,080,204 | | 3/1963 | Lindhgren . |
| 3,330,601 | | 7/1967 | Proctor . |
| 3,423,781 | | 1/1969 | Henson . |
| 3,640,595 | | 2/1972 | Staller et al. . |
| 3,865,446 | | 2/1975 | Mastronardi . |
| 3,923,354 | | 12/1975 | Young . |
| 3,957,323 | | 5/1976 | Tucker et al. . |
| 3,967,868 | | 7/1976 | Baker, Jr. . |
| 4,017,131 | | 4/1977 | Camenisch . |
| 4,033,649 | | 7/1977 | Naito et al. . |
| 4,039,040 | | 8/1977 | Spears et al. . |
| 4,084,125 | | 4/1978 | King . |
| 4,123,126 | | 10/1978 | Querengasser . |
| 4,229,135 | | 10/1980 | Malmros . |
| 4,256,355 | | 3/1981 | Yamaguchi et al. . |
| 4,307,922 | | 12/1981 | Rhodes, Jr. . |
| 4,412,772 | | 11/1983 | Naito et al. . |
| 4,417,524 | | 11/1983 | Quinn et al. . |
| 4,421,365 | | 12/1983 | Taniwaki . |
| 4,441,617 | | 4/1984 | Forsberg . |
| 4,467,924 | | 8/1984 | Morcheles . |
| 4,523,794 | | 6/1985 | Peterman . |
| 4,597,615 | | 7/1986 | Steger . |
| 4,621,876 | | 11/1986 | Reimer . |
| 4,657,317 | | 4/1987 | Gemma . |
| 4,702,535 | | 10/1987 | Beun . |
| 4,705,315 | * | 11/1987 | Cherry ..... 312/334.33 X |
| 4,708,411 | * | 11/1987 | Peterman ..... 312/201 |
| 4,759,341 | * | 7/1988 | McFarland ..... 312/334.27 X |
| 4,789,210 | * | 12/1988 | Weiss et al. ..... 312/201 |
| 4,911,507 | | 3/1990 | Leist . |
| 5,072,838 | | 12/1991 | Price, Jr. et al. . |
| 5,160,189 | | 11/1992 | Johnston et al. . |
| 5,160,190 | | 11/1992 | Farrell et al. . |
| 5,205,627 | | 4/1993 | Davison et al. . |
| 5,265,739 | | 11/1993 | Price, Jr. et al. . |
| 5,410,899 | | 5/1995 | McConnell . |
| 5,417,486 | | 5/1995 | Manlove . |
| 5,435,639 | * | 7/1995 | Smits et al. ..... 312/201 |
| 5,439,281 | | 8/1995 | Croker . |
| 5,443,312 | | 8/1995 | Schluter . |
| 5,597,217 | | 1/1997 | Hoska et al. . |
| 5,598,934 | * | 2/1997 | Krummell et al. ..... 312/201 X |
| 5,636,750 | | 6/1997 | Heyl . |
| 5,670,778 | | 9/1997 | Smith . |
| 5,683,155 | | 11/1997 | Sarno . |
| 5,924,779 | | 7/1999 | Krumholz . |
| 5,944,400 | * | 8/1999 | Fulterer ..... 312/334.33 X |
| 6,027,190 | | 2/2000 | Stewart . |

* cited by examiner

CANTILEVERED PULL-OUT SHELF SYSTEM

BACKGROUND AND SUMMARY OF THE INVENTION

This invention relates to furniture such as shelving or the like, and more particularly to a pull-out system for providing movement of furniture such as high density shelving between a retracted position and an extended position.

Various systems are known for providing pull-out movement of an article of furniture, such as a shelf, bookcase or the like, between a retracted position and an extended position. Systems of this type are useful for providing high density storage, in that there is no aisle between adjacent units. Access to a unit is obtained by pulling the unit outwardly to its extended position while leaving the adjacent units in the retracted position. This enables a user to access stored items from the front or rear of the unit.

Several types of known systems provide movement of a storage unit via engagement with a supporting surface such as a floor. In one form, the unit is mounted to a base having a set of wheels which provides movable support for the unit as it is moved between its extended and retracted positions. Another construction involves a hidden track system which is movable along with the unit and which includes spaced support members which engage the supporting surface as the unit is pulled outwardly to its extended position, and which are moved upwardly out of engagement with the supporting surface as the unit is returned to its retracted position. While these systems function satisfactorily to provide movement of a storage unit between extended and retracted positions, each is disadvantageous in certain applications in that the unit engages the floor as it is moved between its extended and retracted positions. In some usage environments, the unit will be mounted to or adjacent a floor having a wearable floor covering such as carpet, and repeated movements of the unit between its extended and retracted positions results in wear of such floor coverings.

To overcome this drawback, it is known to mount a stationary base to the floor, and to provide a telescoping frame assembly between the base and the storage unit. The telescoping frame assembly is adapted to provide cantilevered movement of the storage unit between its extended and retracted positions, without engagement with the floor or other supporting surface. This type of system functions generally satisfactorily, but the telescoping frame assembly is complex, heavy and difficult to manufacture and assemble in a cost-effective manner.

It is an object of the present invention to provide a cantilevered extension and retraction system for use in combination with an article of furniture, to provide movement of the article of furniture between an extended and retracted position without engagement with a supporting surface such as a floor. It is a further object of the invention to provide such a system which is relatively simple in its components and construction, yet which provides highly satisfactory and easy movement of the storage unit between its extended and retracted positions. It is a further object of the invention to provide such a system which involves a novel application of conventional components in an extension and retraction system. A still further object of the invention is to provide such a system which is easy to install and to interconnect with conventionally constructed storage units. A still further object of the invention is to provide such a system which can be differently configured to accommodate varying load requirements for the article of furniture.

In accordance with one aspect of the invention, a cantilevered pull-out system for an article of furniture, such as a storage unit, includes a base arrangement for mounting to a supporting surface such as a floor. One or more extendible and retractable slide members are adapted for interconnection with the base arrangement, and each slide member includes a stationary portion mounted to the base arrangement and an extendible and retractable portion movably mounted to the stationary portion. The article of furniture is adapted to be mounted to a support structure, which is secured to the extendible and retractable portion of each slide member. The slide members are constructed and arranged to provide movement of the support structure and the article of furniture between a retracted position in which the support structure and the article of furniture are located over the base arrangement, and a cantilevered extended position in which the support structure and the article of furniture are moved outwardly relative to the base without engagement of the support structure with the supporting surface.

The base arrangement is preferably in the form of two or more base members, each of which includes a slide member mounting section and a floor-mounting section for securement to the supporting surface. The stationary portion of each slide member is adapted for mounting to the slide member mounting section of each base member. The base members are separate from each other, and the floor-mounting section of each base member is secured to the supporting surface separately from that of the other base members. The stationary portions of the slide members span between and are supported above the supporting surface by the slide member mounting sections of the base members. The number of extendible and retractable slide members is selected according to the load requirements for the article of furniture, and the configuration of the slide member mounting section of each base member can vary according to the number of slide members to be mounted to the base members. The floor-mounting section of each base member is preferably in the form of a floor-engaging member which extends substantially transversely to the direction of movement of the support structure and the article of furniture between its extended and retracted positions, and the slide member mounting section of each base member is in the form of a series of slide mounting members extending upwardly from the floor-engaging member. Each floor-engaging member includes a floor-engaging flange adapted to receive one or more fasteners for engagement with the floor or other supporting surface, and an adjustable elevation member spaced from the floor-engaging flange. In a preferred form, each floor-engaging member defines a wall spaced vertically above the floor-engaging flange, and the adjustable elevation member includes a foot located below the wall and engageable with the supporting surface, and a threaded shank extending upwardly from the foot. The threaded shank is engaged with threaded structure associated with the wall of the floor-engaging member, such that turning of the threaded shank results in adjustment of the elevation of the foot to provide leveling of the floor-engaging member.

The one or more extendible and retractable slide members are preferably in the form of a series of substantially identically constructed slide members interposed between the base arrangement and the support structure. Each slide member may be a telescoping slide assembly, and the stationary portion of each slide assembly includes an axially extending guide member mounted to the base arrangement along its length. The base arrangement includes a pair of slide member mounting sections spaced along the length of the guide member of each slide assembly, and each guide member is mounted to the spaced slide member mounting sections. The extendible and retractable portion of each slide member is in the form of an extension member adapted for inward and outward telescoping movement relative to the guide member. The support structure is secured to the extendible and retractable portion of each slide member by means of an axially extending support member mounted to each extension member and engaged with the support structure.

The support structure preferably includes a releasable engagement arrangement for providing releasable mounting of the article of furniture to the support structure. In a preferred form, the support structure includes a rigid frame section for securement to the article of furniture, and a series of support members interposed between the rigid frame section and the extendible and retractable portions of the slide members. The support members are preferably in the form of elongated structural support members, each of which is mounted to an extension member of one of the slide members. In a preferred form, an outer pair of support members are interconnected with a pair of spaced cross-members, to make up the rigid frame section. Each support member may include a pair of spaced, upwardly extending projections which extend through a pair of openings formed in a transverse wall associated with the spaced crossmembers of the rigid frame section. A spacer arrangement may be interposed between the transverse wall and selected ones of the support members, for ensuring that the support members and the slide assemblies are equally loaded.

The invention further contemplates a method of assembling a pull-out mechanism for an article of furniture, such as a storage member. The method involves the steps of securing the article of furniture to a mounting structure, and providing a base arrangement adapted for securing to a supporting surface. The method further includes connecting a series of substantially identically constructed extendible and retractable slide assemblies between the base arrangement and the mounting structure. The number of slide assemblies is selected according to the load requirements for the article of furniture. The slide assemblies are interconnected with the mounting structure and the base arrangement, and provide movement of the mounting structure and the article of furniture between retracted and extended positions. The base arrangement is preferably in the form of a series of base members, each of which is adapted for separate mounting to the supporting surface. The step of interconnecting the slide assemblies with the base arrangement is carried out by securing a fixed inner portion of each slide assembly to one of a series of mounting areas associated with each base member. The method further includes the step of varying the configuration of the base member according to the selected number of slide assemblies, to provide the required number of mounting areas for the selected number of slide assemblies. Each base member preferably includes a floor-engaging member, and the step of varying the configuration of the base member is carried out by securing a series of slide mounting members to the floor-engaging member in configurations adapted to mount varying numbers of fixed inner slide assembly portions.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
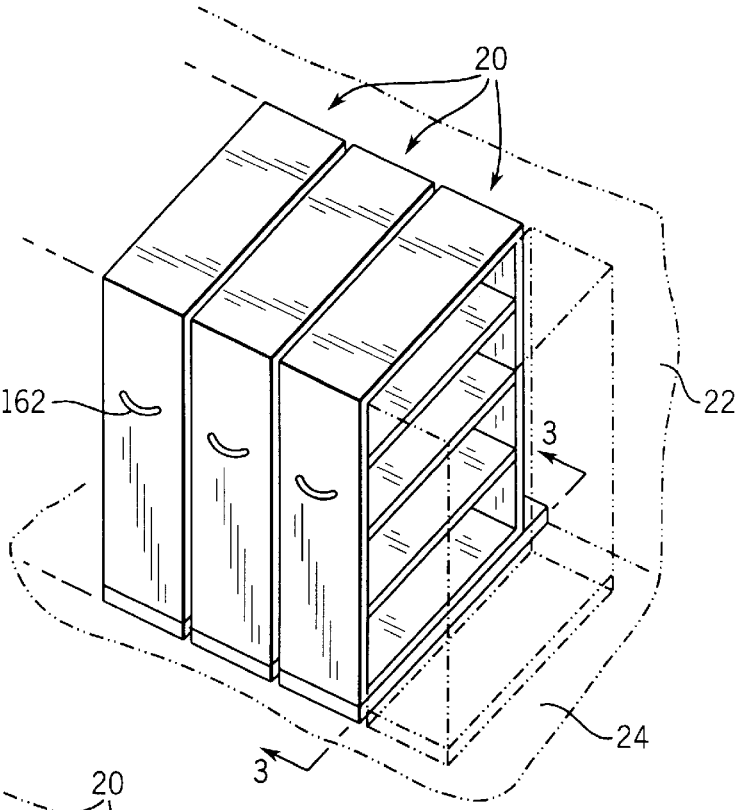
FIG. 1 is an isometric view of a number of storage members or units incorporating the extension and retraction system of the present invention, showing the units in a retracted position.

FIG. 1 illustrates a series of storage units or assemblies 20 mounted adjacent a wall 22 and supported by a floor or other supporting surface 24. In FIG. 1, each storage assembly 20 is shown in a retracted position, in which a side of each storage assembly 20 is located adjacent wall 22. Storage assemblies 20 are located immediately adjacent each other, and are typically installed in a row of numerous similarly constructed storage assemblies 20, to provide high density storage along wall 22.

Figure 2:
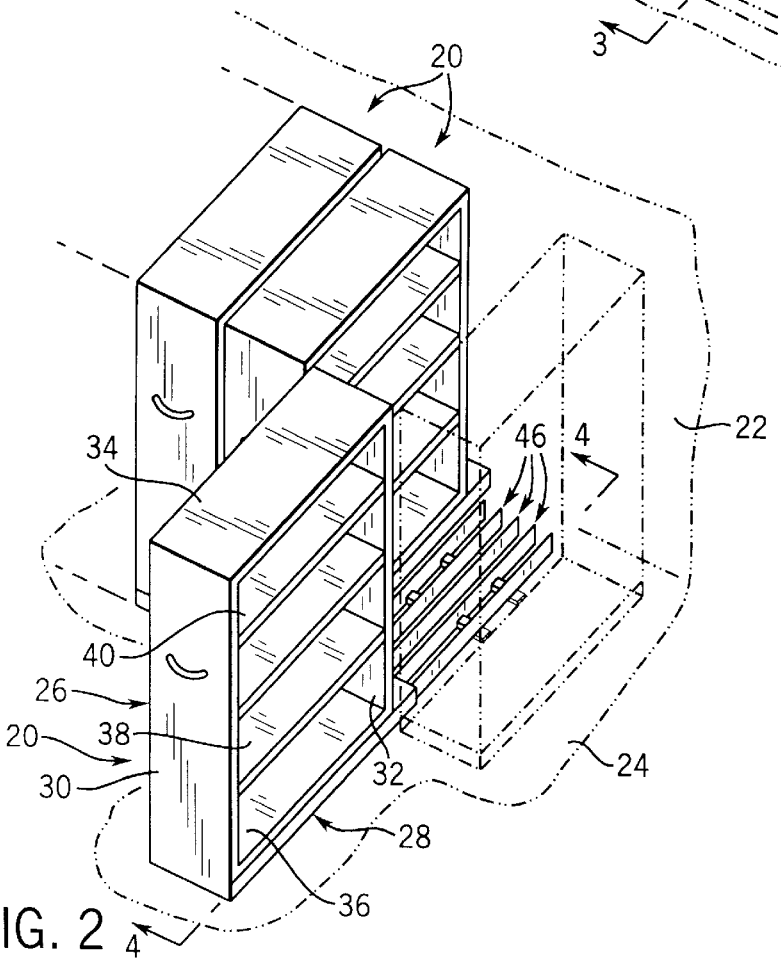
FIG. 2 is a view similar to FIG. 1, showing movement of one of the units to an extended position to provide access to items stored on the storage unit.

Each storage assembly 20 is movable between a retracted position and an extended position. Storage assemblies 20 of FIG. 1 are shown in the retracted position, and the endmost one of storage assemblies 20 in FIG. 2 is illustrated as being moved to its extended position.

Each storage assembly 20 is in the form of a storage cabinet 26 mounted to a base or mounting structure 28, in a manner to be explained. Storage cabinet 26 is of conventional construction, including a pair of spaced sides 30, 32, a top 34, and a bottom 36 which cooperate to define an internal storage space 38 which may be subdivided using a series of shelves 40. Storage cabinet 26 has an open front which provides access to internal storage space 38, and is preferably closed at its rear. When one of storage cabinets 26 is in its extended position as shown in FIG. 2, internal storage space 38 is fully exposed so as to provide access to items stored on shelves 40. When retracted, storage cabinets 26 are located immediately adjacent each other without aisles therebetween, such that the front of each storage cabinet 26 can only be accessed by moving the storage cabinet 26 to its extended position.

While each storage assembly 20 is illustrated as including an open front storage cabinet 26, it is understood that other types of storage members, such as file cabinets or storage cabinets with doors, may be incorporated into storage assembly 20.

Each storage cabinet 26 extends along a longitudinal axis, along which the storage cabinet 26 is movable between its extended and retracted positions, in a manner to be explained. The open front of each storage cabinet 26 opens in a direction transverse to the longitudinal axis.

Figure 3:
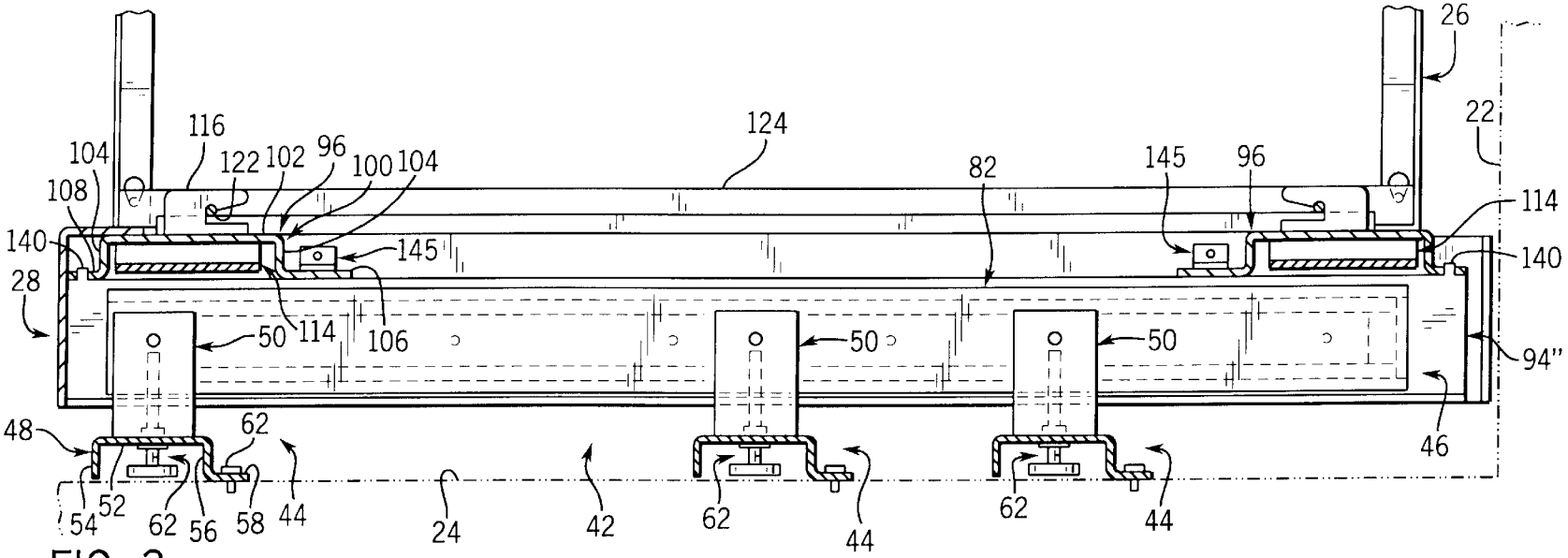
FIG. 3 is a section view taken along line 3—3 of FIG. 1.
Figure 4:
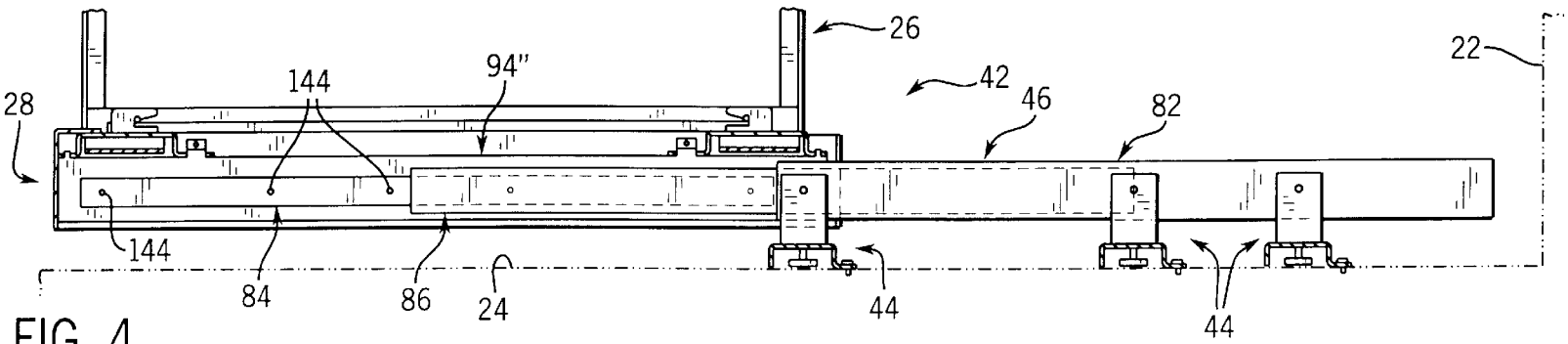
FIG. 4 is a section view taken along line 4—4 of FIG. 2.
Figure 5:
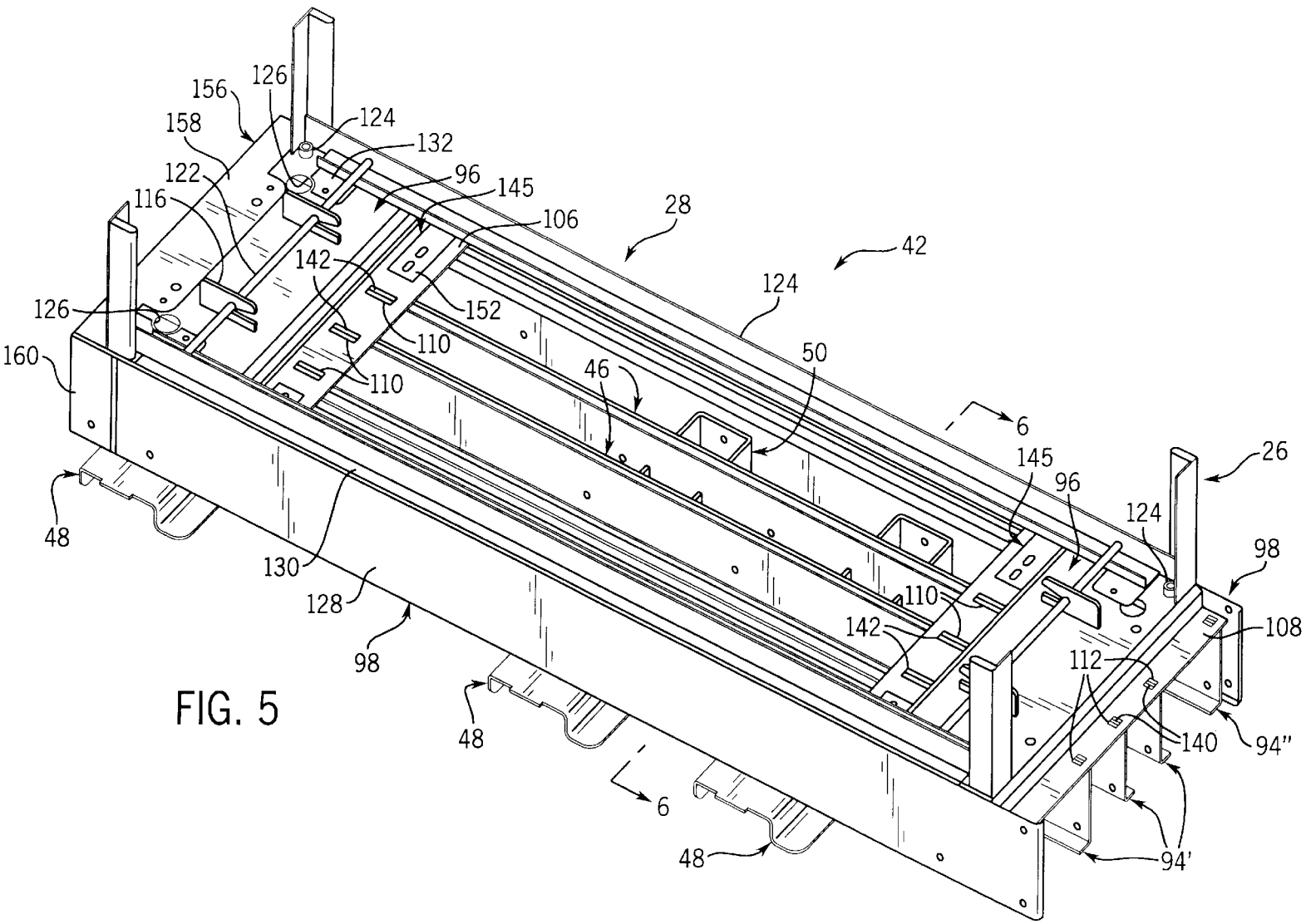
FIG. 5 is an isometric view of the extension and retraction system incorporated into the storage units of FIGS. 1 and 2, shown in a retracted position.

Referring to FIGS. 3–5, mounting structure 28 of each storage assembly 20 is connected to a cantilever-type extension system 42 for providing movement between an extended position as in FIG. 2 and a retracted position as in FIG. 1. Generally, extension system 42 includes a base arrangement in the form of a series of base members 44, in combination with a series of identically constructed self-contained slide assemblies 46 interconnected between base members 44 and mounting structure 28.

Base members 44 are substantially identical in construction, and include an outer base member 44 positioned under the outer end of cabinet 26 when storage assembly 20 is in its retracted position, as shown in FIG. 3. An intermediate storage member 44 is positioned approximately midway along the length of storage cabinet 26 when storage assembly 20 is in its retracted position, and an inner base member 44 is located between the intermediate storage member 44 and the inner end of storage cabinet 26 adjacent wall 22, when storage assembly 20 is in its retracted position.

Figure 6:
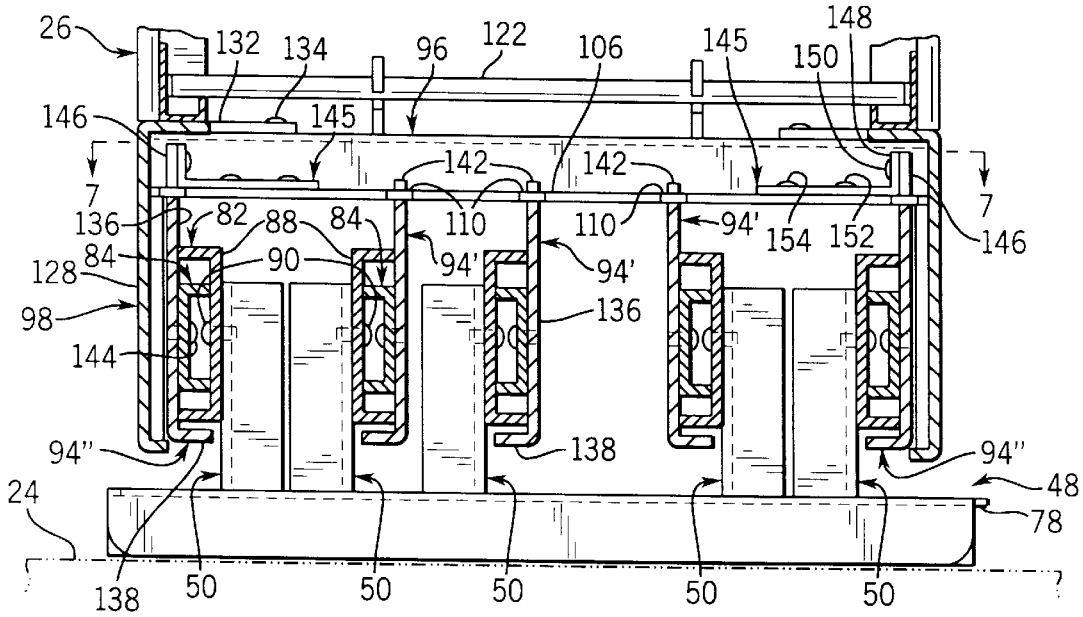
FIG. 6 is a section view taken along line 6—6 of FIG. 5.
Figure 7:
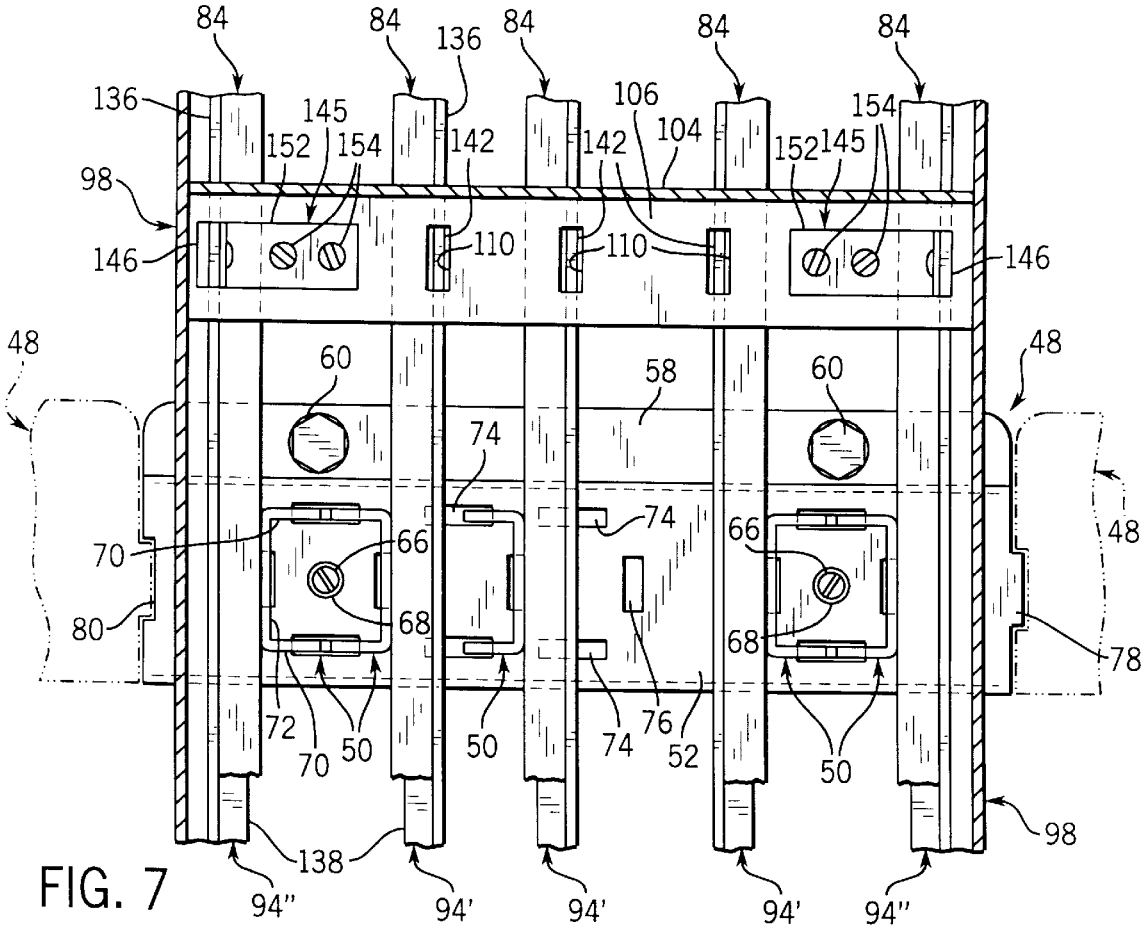
FIG. 7 is a partial section view taken along line 7—7 of FIG. 6.
Figure 8:
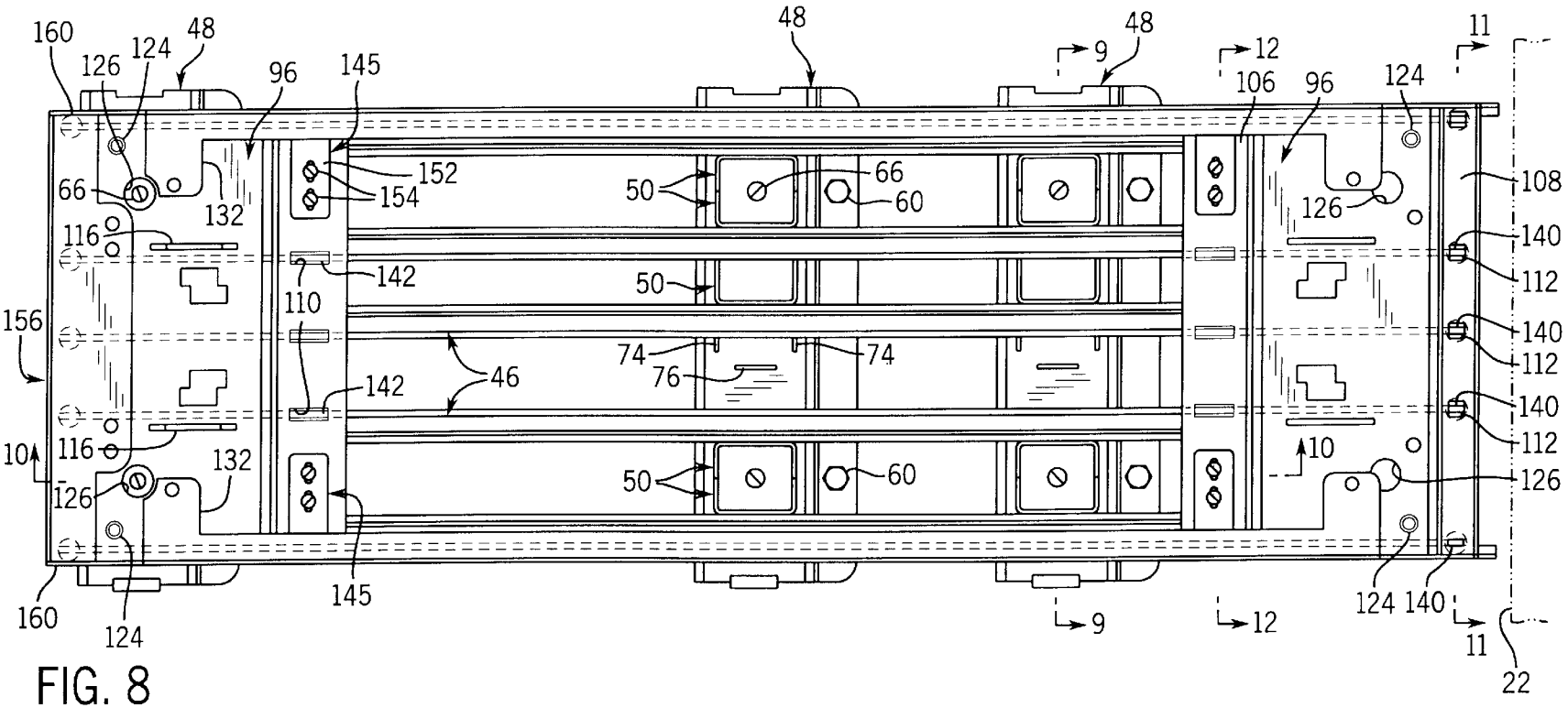
FIG. 8 is a top plan view of the extension and retraction system of FIG. 5.

Each base member 44 includes a floor-engaging member 48 and a series of slide mounting members 50 extending upwardly from each floor-engaging member 48. Referring to FIGS. 6 and 7, each floor-engaging member 48 defines spaced ends which are located outwardly of the sides of mounting structure 28, and slide mounting members 50 are located along the length of floor-engaging member 48 between its ends.

Each floor-engaging member 48 is in the form of an inverted channel defining a top wall 52, a front wall 54 and a rear wall 56. A flange 58 extends rearwardly from the lower end of rear wall 56, and is adapted to engage floor 24. Flange 58 includes one or more openings for receiving fasteners 60, which may be in the form of bolts adapted to engage anchors mounted in floor 24 at the location of each opening in flange 58. In this manner, fasteners 60 function to securely mount each base member 44 to floor 24.

Figure 9:
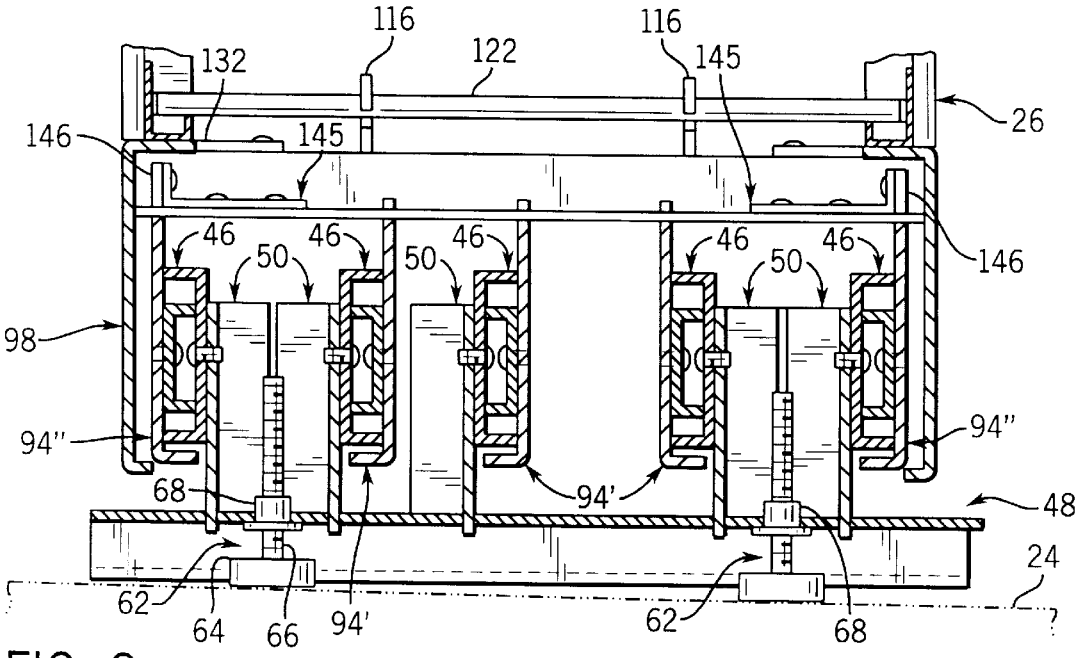
FIG. 9 is a section view taken along line 9—9 of FIG. 8.

Referring to FIG. 9, at least a pair of leveling members 62 is mounted to each floor-engaging member 48 at spaced locations along its length. Leveling members 62 are preferably located inwardly of the ends of each floor-engaging member 48. Each leveling member includes a foot 64 and a threaded shank 66 extending upwardly from foot 64. A nut 68 is mounted within an opening formed in top wall 52 of floor-engaging member 48, for receiving the threads of shank 66. The top of shank 66 includes a transverse slot, which is adapted to receive the end of a screwdriver or other satisfactory tool to enable shank 66 to be turned by a user and to thereby adjust the elevation of foot 64, to provide leveling of base member 44 in a transverse direction. Leveling members 62 are also operated to provide longitudinal leveling of base members 44, in a manner to be explained.

Slide mounting members 50 are in the form of endwise-mounted channel members, as shown in FIGS. 6 and 7. Each slide mounting member 50 includes a pair of spaced flanges 70 extending from a web 72. A series of aligned, spaced slots 74 are formed in top wall 52 of each floor-engaging member 48 adjacent each side of top wall 52, and a series of spaced transversely extending slots 76 are formed in top wall 52, extending outwardly from the centerline of top wall 52. The lower end of each flange 70 includes a tab adapted for engagement within one of slots 74, and the lower end of each web 72 includes a tab for engagement within one of slots 76, so as to locate slide mounting members 50 on top wall 52 of floor-engaging member 48. Slots 74 and 76 are configured such that, when the tab of a web 72 is received within one of slots 76, the tab of each flange 70 is received within an end area of one of slots 74. As shown in FIG. 7, two of slide mounting members 50 may be placed in a back-to-back relationship to form a rectangular section, and the adjacent ends of flanges 70 may be welded together to form a tubular mounting structure extending upwardly from floor-engaging member 48. In addition, the bottom edge of each slide mounting member 50 is preferably welded to the upper surface of top wall 52, such that slide mounting members 50 and floor-engaging member 48 are connected in a weldment adapted to be secured to floor 24.

As shown in FIG. 7, one end of each floor-engaging member 48 includes a tab 78 extending from top wall 52, and the opposite end of each floor-engaging member 48 includes a recess 80 formed in top wall 52. This construction provides a mating configuration, in that the tab 78 of one of floor-engaging members 48 may be received within the recess 80 of an adjacent floor-engaging member 48, to provide alignment of a series of base members 44 when installing a number of adjacent storage assemblies 20.

Referring to FIG. 4, each slide assembly 46 includes a stationary or fixed-position inner guide member 82, an outer extension member 84, and an intermediate slide member 86 interposed between guide member 82 and extension member 84. Each slide assembly 46 is of conventional construction, and may representatively be that such as is available from Jonathan Manufacturing Corp. of Fullerton, Calif. under its Model No. 432. Extension member 84 is slidably mounted for telescoping inward and outward movement relative to intermediate slide member 86, which in turn is slidably mounted for telescoping inward and outward movement relative to guide member 82. In this manner, slide assembly 46 provides a range of inward and outward movement defined by the limit of extension of intermediate member 86 relative to guide member 82 and outer extension member 84 relative to intermediate slide member 86.

Each guide member 82 includes a vertical wall 88, which is adapted for placement against the outer surface of web 72 of one of slide mounting members 50, as shown in FIGS. 6 and 7. A fastener, such as a screw 90, extends through an opening in vertical wall 88 into engagement with an aligned threaded opening in web 72, for mounting guide member 82 to one of slide mounting members 50 of each base member 44. Base members 44 are positioned such that the slide mounting members 50 of each base member 44 are in alignment with each other in a front-to-rear direction. In this manner, a series of slide assemblies 46 are mounted to each base member 44 by engagement with one of slide mounting members 50 of each base member 44. The alignment of base members 44 ensures that, when slide assemblies 46 are mounted in this manner, the direction of extension and retraction of each slide assembly 46 is parallel to that of the other slide assemblies 46, which normally is perpendicular to the plane of wall 22.

Referring to FIGS. 3–5 and 8, mounting structure 28, to which storage cabinet 26 is mounted, generally includes a rigid frame assembly or section 92 in combination with a series of inner support members 94' which are interposed between rigid frame assembly 92 and the outer extension member 84 of the inner ones of slide assemblies 46. A pair of outer support members 94" form a part of rigid frame assembly 92, and each outer support member 94" is engaged with outer extension member 84 of one of the outer slide assemblies 46.

Rigid frame assembly 92 includes a pair of mirror image upper cross-member assemblies 96 interconnected by outer support members 94". Each upper cross-member assembly includes an inverted shallow channel member 100 defining a top wall 102 and a pair of depending side walls 104. An inner flange 106 extends inwardly from the inner one of side walls 104, and an outer flange 108 extends outwardly from the outer one of side walls 104. A series of slots 110 are formed in inner flange 106, and a series of openings 112 are formed in outer flange 108 in alignment with slots 106.

A mounting member, shown generally at 114, is secured to channel member 100. Mounting member 114 includes a pair of mounting tabs 116 which extend through slots formed in channel member top wall 102. Each mounting tab 116 extends upwardly from a side wall 118 which is located within the internal space defined by channel member 100. A bottom wall 120 extends between and interconnects side walls 118. A weld is provided between mounting member 114 and top wall 102, such as at the location where each tab 116 protrudes from the upper surface of top wall 102, to secure mounting member 114 and channel member 100 together. Mounting member tabs 116 define slot structure which is adapted to releasably engage a locking rod 122, the ends of which overlap a pair of lower frame members 124 of storage cabinet 126. Engagement of locking rods 122 within the slot of each tab 116 functions to clamp storage cabinet 26 against the upper surface of top wall 102, to firmly secure storage cabinet 26 to rigid frame assembly 92. The details of the manner in which mounting tabs 116 and locking rod 122 interact to secure storage cabinet 26 in place are set forth in copending application Ser. No. 09/328,478 filed Jun. 9, 1999, the disclosure of which is hereby incorporated by reference.

A series of studs 124 are mounted to top wall 102 of channel member 100, and are positioned to locate the comers of storage cabinet 26 relative to rigid frame assembly 92. A pair of openings 126 are formed in channel member top wall 102, for providing access to the slots in the top ends of threaded shanks 66 of leveling members 62, to provide the user with access to threaded shanks 66 to level extension system 42 upon initial installation.

A pair of side cover members 98 span between upper cross-member assemblies 96. Side cover members 98 conceal the sides of mounting structure 28, and each includes a side wall 128 and an upper lip 130 extending inwardly from the upper end of side wall 128. Upper lip 130 overlaps the outer end of each channel member top wall 102, and includes a lateral projection 132 which is mounted to channel member top wall 102 via a fastener 134.

Support members 94' and 94" are generally L-shaped, defining a vertical web 136 and a horizontal flange 138 at the lower end of web 136. A projection 140 having a relatively short length is formed at both the outer and inner end of each support member 94' and 94", and a pair of projections 142 having a length longer than that of each projection 140 is formed on each support member 94" inwardly of each projection 140. Projections 140 are adapted to be received within openings 112 in each channel member outer flange 108, and projections 142 are adapted for engagement within slots 110 formed in each channel member inner flange 106. As shown in FIG. 4, a series of fasteners 144 are employed to connect webs 136 of support members 94' and 94" to outer extension member 84 of each slide assembly 46. This functions to interconnect each slide assembly 46 with mounting structure 28, to enable movement of mounting structure 28 inwardly and outwardly relative to base members 44 and guide member 82.

Engagement of projections 140 within openings 112 and projections 142 within slots 110 functions to fix support members 94' and 94" to upper cross-member assemblies 96, such that support members 94 and upper cross-member assemblies 96 are movable inwardly and outwardly as a unit.

A series of L-shaped brackets 145 are provided for interconnecting each channel member 102 with outer support members 94", such that channel members 102 and outer support members 94" cooperate to define rigid frame section 92. Each outer support member 94" includes an extended projection 146, and each bracket 145 includes a vertical leg 148 attached to extended projection 146 via a screw 150. Each bracket 145 further includes a horizontal leg 152 which overlies channel member inner flange 106 and is secured thereto by a pair of screws 154. With this arrangement, outer support members 94" function to structurally interconnect upper cross-member assemblies 96, to form a rigid framework which is interconnected with the outer slide assemblies 46 via connection of outer support members 94" with outer extension members 84 of the outer slide assemblies 46.

In the illustrated embodiment, the rigid framework of mounting structure 28 is made up of channel members 102 in combination with outer support members 94". Alternatively, the rigid framework could be made up of a pair of cross-members welded or otherwise rigidly interconnected with a pair of longitudinal frame members, separate from the support members such as 94". The separate rigid framework may be connected to outer extension members 84 in any satisfactory manner, such as in the same manner as support members 94' are interconnected with channel members 102.

A front cover member, shown generally at 156, functions to conceal the front of mounting structure 28. Front cover member 156 includes a top wall 158 which overlaps and is engaged with channel member top wall 102, and a depending front wall which is bent rearwardly at its ends to form a pair of front side walls 160. With this arrangement, the exposed portions of mounting structure 28 are concealed by side cover members 98 and front cover members 156, to finish the external appearance of mounting structure 28 and to prevent access or damage to internal components.

Figure 10:
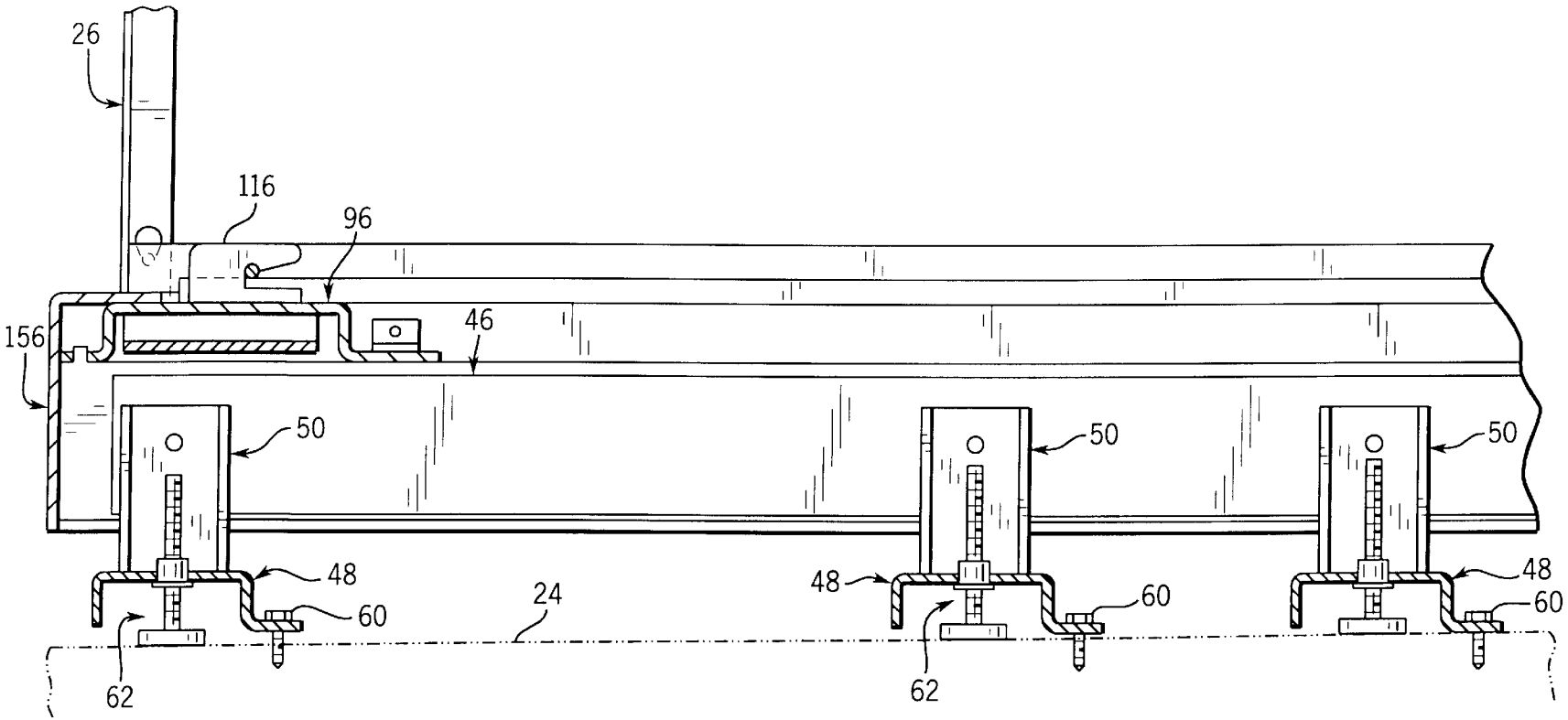
FIG. 10 is a partial section view taken along line 10—10 of FIG. 8.

Referring to FIG. 10, base members 44 are leveled in both directions to ensure even movement of each storage assembly 20 between its extended and retracted position. Such leveling is accomplished by manipulating anchor bolts 60 and leveling members 62, to adjust the elevation of each base member 44 at the location of each leveling member 62 in both a longitudinal direction and a transverse direction, so as to provide a level condition for each guide assembly 46.

Figure 11:
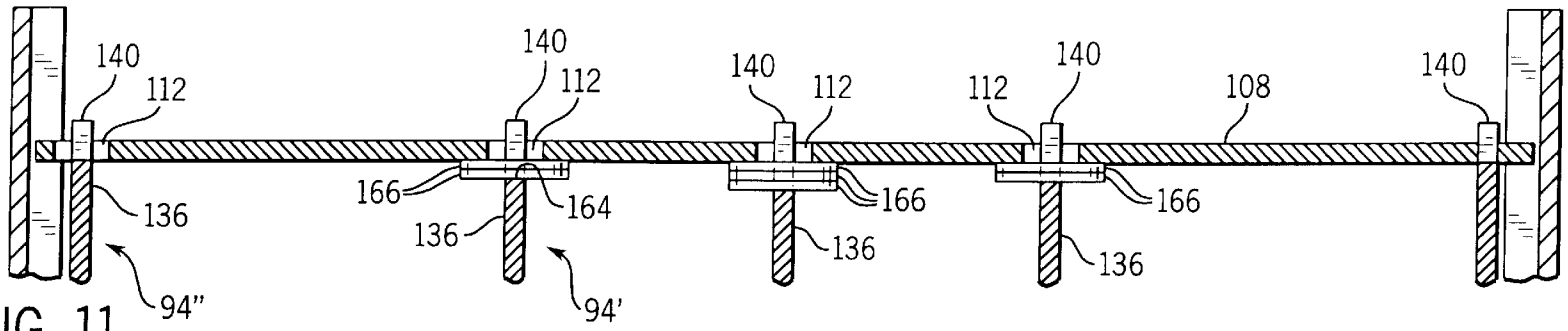
FIG. 11 is a partial section view taken along line 11—11 of FIG. 8.

Referring to FIG. 11, inner support members 94' are set at an elevation lower than that of outer support members 94". Each projection 140 of each inner support member 94' extends upwardly from an upper edge 164, and a series of shims 166 are interposed between upper edge 164 and the underside of channel member outer flange 108 to ensure that each slide assembly 46 carries a share of the load of storage assembly 20. Each projection 140 has a width less than that of each opening 112, and has a length only slightly less than that of opening 112. In this manner, each support member 94' is capable of "floating" side-to-side movement while the relative longitudinal movement between each support member 94' and outer flange 108 is restricted by engagement of projection 140 with the front and rear edges of opening 112. Upon installation, the user simply varies the number of shims for each inner support member 94' according to the elevation of each support member 94' to ensure that support members 94' are equally loaded.

Figure 12:
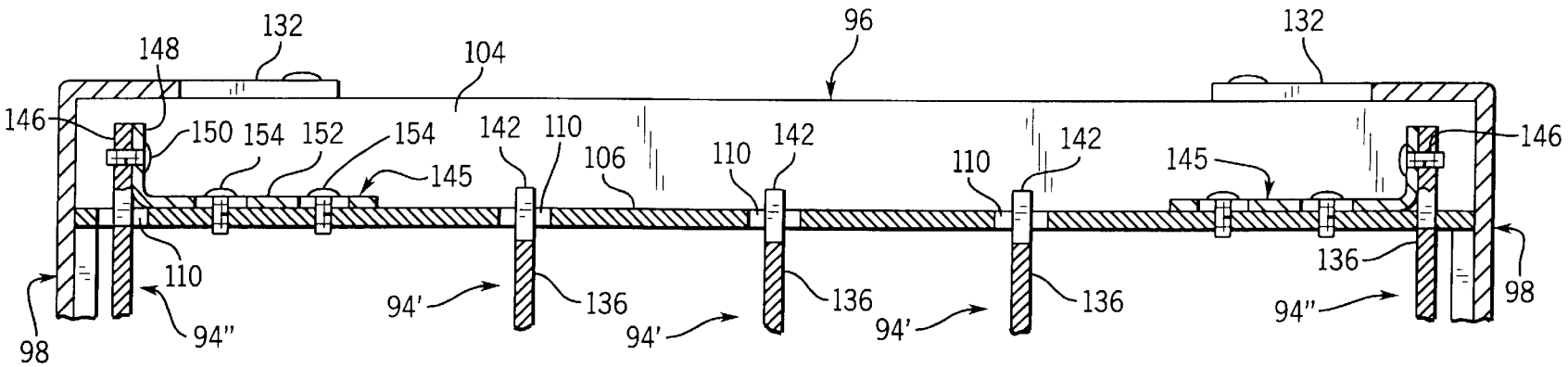
FIG. 12 is a partial section view taken along line 12—12 of FIG. 8.
Figure 13:
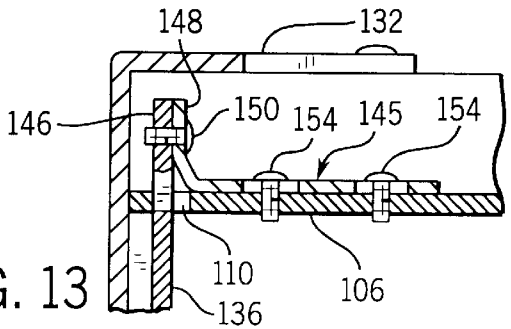
FIG. 13 is an enlarged view of an end portion of FIG. 12.

Referring to FIG. 12, the projection 142 of each inner support member 94' is received within its respective slot 110. Again, slots 110 each have a width greater than that of projection 142, to accommodate lateral "floating" movement between support members 94' and channel member inner flange 106. Screws 150, which secure brackets 144 to the extended flange 146 of each outer support member 94", functions to transfer a proportionate share of the load of storage assembly 20 to outer support members 94". FIG. 13 shows lateral movement of a projection 146 of one of supporting members 94" within slot 110 and slight deflection of vertical leg 148 of bracket 145 to accommodate such lateral movement.

In operation, storage assemblies 20 are movable from the retracted position of FIG. 1 to the extended position of FIG. 2 by means of the user exerting an outward, pull-out force on a desired one of storage assemblies 20 using a handle 162. Application of such a pull-out force is transferred from storage cabinet 26 to mounting structure 28 and thereby to slide assemblies 46 through support members 94. The outward force causes extension of outer extension member 84 relative to intermediate slide member 86, and outward movement of intermediate slide member 86 relative to guide member 82. Slide assemblies 46 each include stop structure for preventing outward movement beyond a predetermined location, which is sufficient to provide full access to storage cabinet internal base 38 when moved to an extended position, as shown in FIG. 2. When it is desired to return storage assembly 20 to its retracted position of FIG. 1, the user exerts a push-in force on the extended storage assembly 20, which is transferred to slide assemblies 46 in the same manner as described above for retracting each telescoping assembly 46 and enabling movement of the extended storage assembly 20 back to its retracted position.

Figure 14:
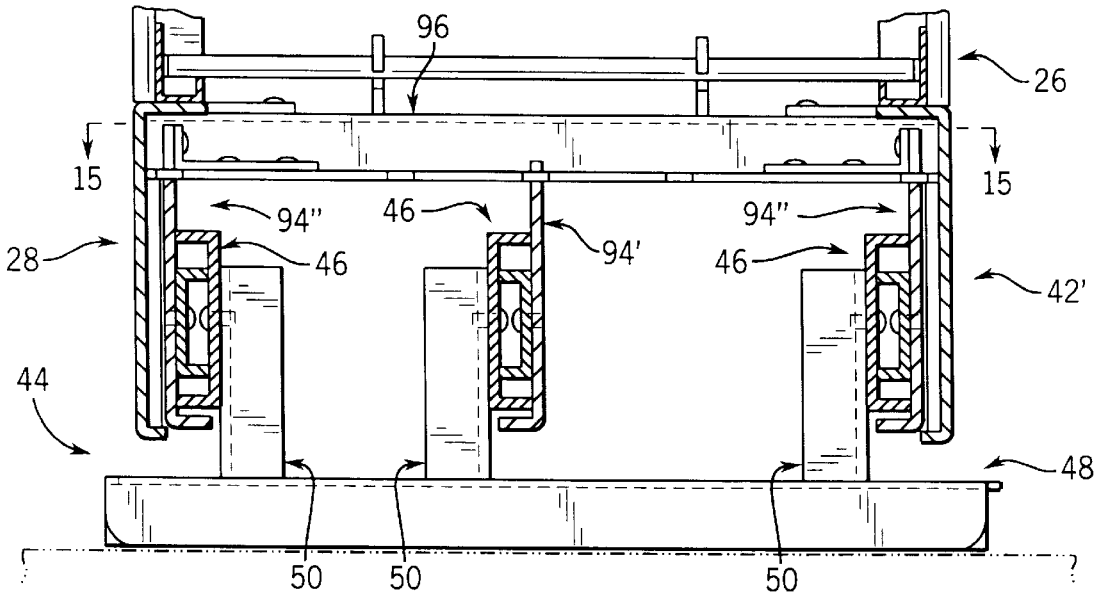
FIG. 14 is a view similar to FIG. 9, showing the configuration of an extension and retraction system for use with a storage unit having a lesser load capacity.
Figure 15:
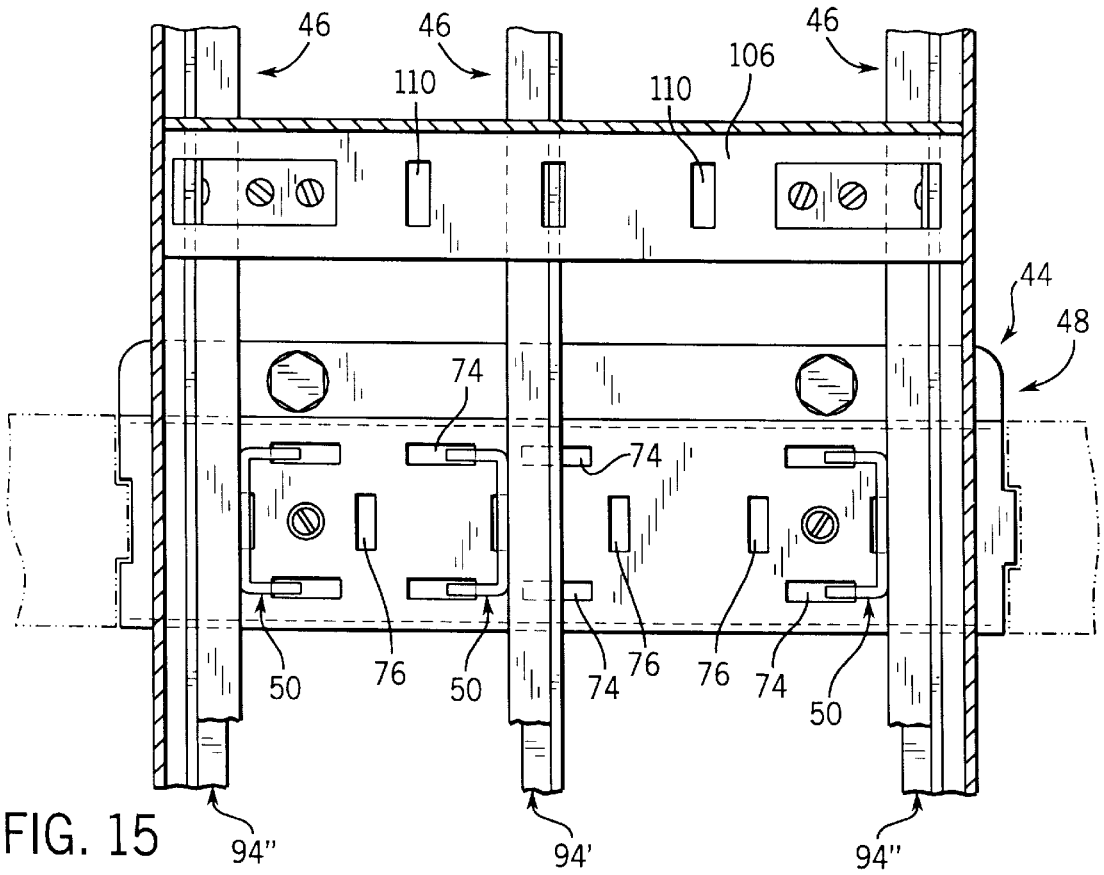
FIG. 15 is a partial section view taken along line 15—15 of FIG. 14.

FIGS. 14 and 15 illustrate a lower-capacity version of an extension system 42' for interposition between supporting structure 28 and base members 44. The version of FIGS. 14 and 15 differs from that described previously in that only three slide assemblies 46 are employed. In this version, only three slide mounting members 50 are secured to each floor-engaging member 48. None of the slide mounting members 50 are back-to-back, and each slide mounting member supports only a single slide assembly 46. Slide mounting members 50 are positioned on floor-engaging member 48 such that slide assemblies 46 are substantially evenly distributed across the width of mounting structure 28. Only selected ones of slots 74, 76 are employed to locate slide mounting members 50, and slide mounting members 50 are mounted to floor-engaging member 48 by welding, as discussed previously. Each slide assembly 46 is mounted to one of slide mounting members 50 and support members 94' and 94" are engaged with mounting structure 28 and slide assemblies 46, all as described previously.

Figure 16:
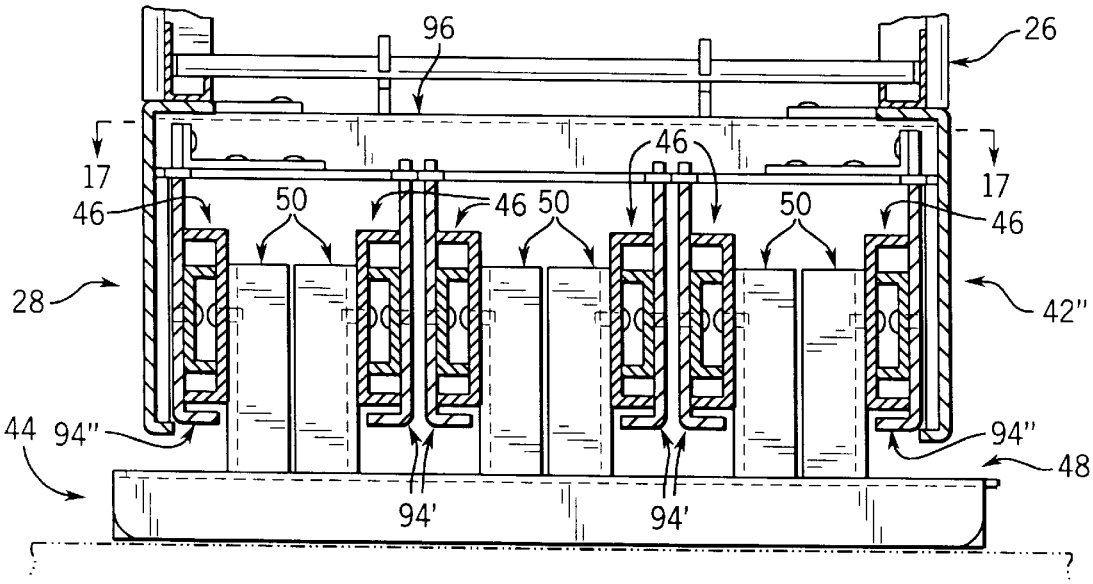
FIG. 16 is a view similar to FIGS. 9 and 14, showing the configuration of an extension and retraction system for use with a storage unit having a greater load capacity.
Figure 17:
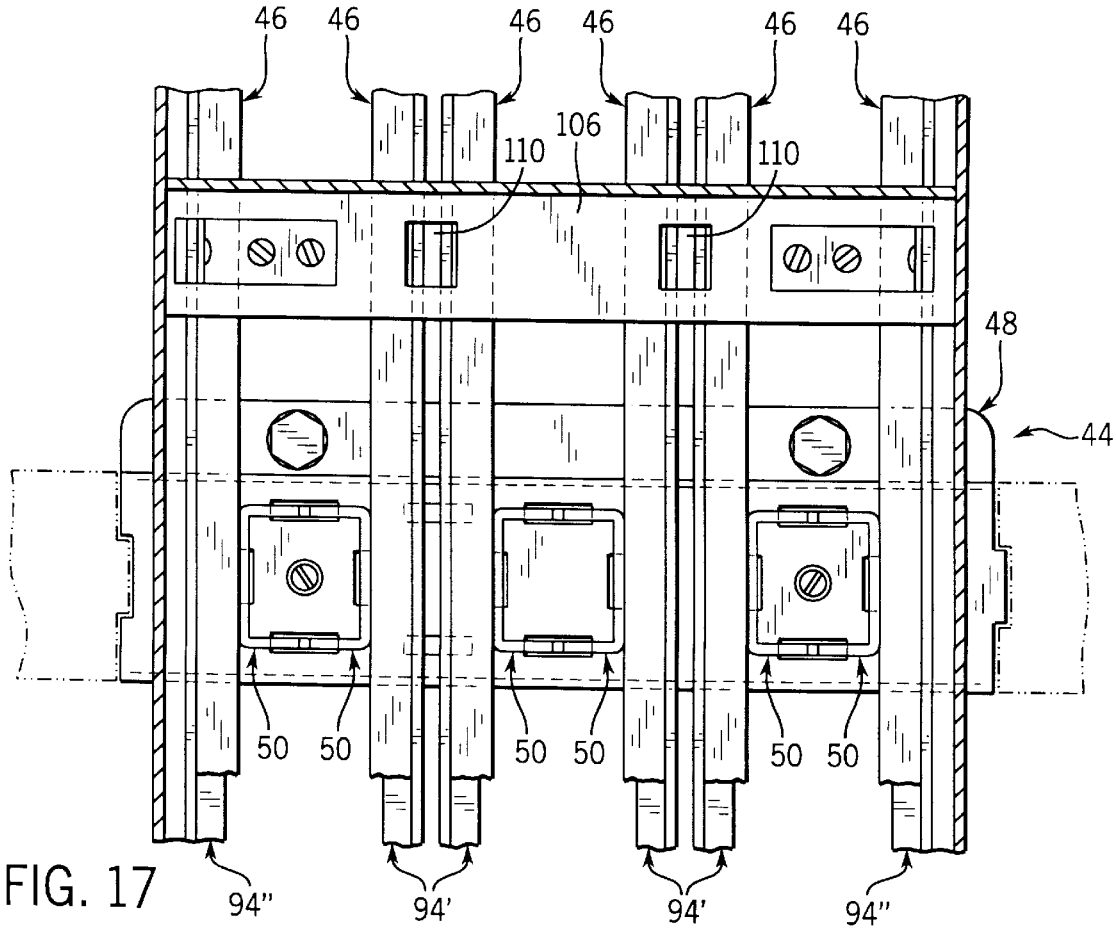
FIG. 17 is a partial section view taken along line 17—17 of FIG. 16.

FIGS. 16 and 17 illustrate the configuration of an extension system 42" having a greater capacity than that illustrated in FIGS. 1–13. In this version, each slide mounting member 50 is oriented in a back-to-back relationship with another slide member 50, and a slide assembly 46 is mounted to the mounting wall of each slide mounting member 50. In this embodiment, each slot 74 and 76 is used to locate one of slide mounting members 50, which are welded both to floor-engaging member 48 and to each other to form rigid tube assemblies extending upwardly from floor-engaging member 48. Again, slide assemblies 46 are mounted to slide mounting members 50 and support members 94' and 94" are engaged with mounting structure 28 and slide assemblies 46, all as described previously.

In the versions of FIGS. 14, 15 and 16, 17, the configuration of the slots in channel member flanges 106 and 108 is varied according to the number of slide assemblies 46 employed for each version of extension system 42.

It can thus be appreciated that any number of slide assemblies 46 can be employed according to the load requirements of storage cabinet 26. In this manner, the same basic design of mounting structure 28 and base members 42 can easily be adapted to vary the capacity of storage assemblies 20, according to user or manufacturer requirements.

The invention thus provides a highly efficient and effective mechanism for providing movement of a storage cabinet between extended and retracted positions. The invention utilizes conventional slide assemblies in a novel application, and provides a simple and efficient system for interconnecting the slide assemblies with a storage cabinet and for mounting the slide assemblies to a floor.

Various alternatives and embodiments are contemplated as being within the scope of the following claims particularly pointing out and distinctly claiming the subject matter regarded as the invention.

I claim:

1. A cantilevered pull-out system for an article of furniture, comprising:

a base arrangement adapted to be stationarily mounted to a supporting surface;

a plurality of separate, self-contained extendible and retractable slide members, wherein each slide member is detachably mounted to the base arrangement independently of the other slide members, and wherein each slide member includes a stationary portion and an extendible and retractable portion slidably mounted to the stationary portion for extension and retraction relative to the stationary portion, wherein the stationary portion of each slide member is mounted to the base arrangement separately from the stationary portion of each of the remainder of the slide members, and wherein the extendible and retractable portion of each slide member is extended and retracted relative to its respective stationary portion separately from the extendible and retractable portions of the remainder of the slide assemblies; and a support structure to which the article of furniture is adapted to be mounted, wherein the support structure is secured to the extendible and retractable portion of each slide member;

wherein the slide members are constructed and arranged to provide movement of the support structure and the article of furniture between a retracted position in which the extendible and retractable portion of each slide member is retracted relative to its respective stationary portion and the support structure and the article of furniture are located over the base arrangement, and a cantilevered extended position in which the extendible and retractable portion of each slide member is extended relative to its respective stationary portion and the support structure and the article of furniture are moved outwardly relative to the base arrangement without engagement of the support structure with the supporting surface;

whereby the detachable mounting of each slide member to the base arrangement independently of the other slide members enables the number of slide members to be varied according to the capacity of the article of furniture, and enables each slide member to be removed from the base arrangement for servicing or replacement independently of the other slide members.

2. The pull-out system of claim 1, wherein the base arrangement comprises two or more base members, each of which includes a floor-mounting section for securement to the supporting surface and a slide member mounting section, wherein the stationary portion of each slide member is mounted to the slide member mounting section of each base member.

3. The pull-out system of claim 2, wherein the base members are separated from each other and the floor-mounting section of each base member is adapted to be stationarily mounted to the supporting surface separately from that of the other base members, and wherein the stationary portions of the slide members span between and are supported above the supporting surface by the slide member mounting sections of the base members.

4. The pull-out system of claim 3, wherein the number of extendible and retractable slide members is selected according to the load requirements for the article of furniture, and wherein the configuration of the slide member mounting section of each base member varies according to the selected number of slide members.

5. The pull-out system of claim 3, wherein the floor-mounting section of each base member comprises a floor mounting member extending substantially transversely to the direction of movement of the support structure and the article of furniture between its extended and retracted positions, and wherein the slide member mounting section of each base member comprises a plurality of slide mounting members extending upwardly from the floor mounting member.

6. The pull-out system of claim 5, wherein one or more of the slide mounting members is configured to mount the stationary portion of a pair of slide members.

7. The pull-out system of claim 5, wherein each floor mounting member comprises a floor-engaging flange adapted to receive one or more fasteners for engagement with the supporting surface, and an adjustable elevation member spaced from the floor-engaging flange.

8. The pull-out system of claim 7, wherein each floor mounting member includes a wall spaced vertically above the floor-engaging flange, and wherein the adjustable elevation member comprises a foot located below the wall and engageable with the supporting surface, and a threaded shank extending upwardly from the foot, wherein the threaded shank is engaged with threaded structure associated with the wall such that turning of the threaded shank results in adjustment of the elevation of the foot to provide leveling of the floor mounting member.

9. The pull-out system of claim 1, wherein the plurality of extendible and retractable slide members are substantially identical in construction.

10. The pull-out system of claim 9, wherein each slide member comprises a telescoping slide assembly, and wherein the stationary portion of each slide assembly comprises an axially extending stationary guide member mounted to the base arrangement along its length.

11. The pull-out system of claim 10, wherein the base arrangement includes a pair of slide member mounting sections spaced along the length of the stationary guide member of each slide assembly, wherein each stationary guide member is mounted to the spaced slide member mounting sections of the base arrangement.

12. The pull-out system of claim 10, wherein the extendible and retractable portion of each slide member comprises an extension member adapted for inward and outward telescoping movement relative to the guide member, wherein the support structure is secured to the extendible and retractable portion of each slide member and includes an axially extending support member mounted to each extension member.

13. The pull-out system of claim 1, wherein the support structure includes a releasable engagement arrangement adapted to provide releasable mounting of the article of furniture to the support structure.

14. The pull-out system of claim 1, wherein the support structure includes a rigid frame section adapted to be secured to the article of furniture, and a series of support members interposed between the rigid frame section and the extendible and retractable portions of the slide members.

15. The pull-out system of claim 14, wherein the support members comprise a series of elongated structural support members, each of which is separately mounted to an extendible and retractable portion of one of the slide members and is interconnected with the rigid frame section.

16. The pull-out system of claim 15, wherein each support member is interconnected with the rigid frame section by means of a pair of upwardly extending projections formed on the support member and extending through a pair of openings formed in transverse wall structure associated with the rigid frame section.

17. The pull-out system of claim 16, further comprising a spacer arrangement associated with the support members and engageable with the transverse wall structure of the rigid frame section, wherein a projection of each of the selected support members extends through the spacer arrangement for transferring the load of the article of furniture to the slide members through the rigid frame member.

18. An extension and retraction mechanism for use with an article of furniture, comprising:

a base adapted to be fixed to a supporting surface;

a mounting structure adapted for securement to the article of furniture; and a plurality of separate, self-contained telescoping slide assemblies interposed between the base and the mounting structure, wherein each slide assembly is detachably mounted to the base and the mounting structure separately from the remainder of the slide assemblies, and wherein the slide assemblies are retractable and extendible to provide movement of the mounting structure, and thereby the article of furniture, between a retracted position in which the article of furniture is positioned over the base, and an extended position in which the mounting structure and the article of furniture are moved outwardly relative to the base in a cantilevered manner without engagement with the supporting surface;

whereby the detachable mounting of each slide assembly to the base separately from the remainder of the slide assemblies enables the number of slide assemblies to be varied according to the capacity of the article of furniture, and enables each slide assembly to be removed from the base for servicing or replacement separately from the remainder of the slide assemblies.

19. The extension and retraction mechanism of claim 18, wherein the mounting structure includes a rigid frame section and wherein each telescoping slide assembly includes a fixed portion mounted to the base and an extendible and retractable portion movable relative to the fixed portion between an extended and retracted position, and further comprising a plurality of support members, wherein each support member is mounted to the extendible and retractable portion of each slide assembly and interconnected with the rigid frame section separately from the remainder of the support members.

20. The extension and retraction mechanism of claim 18, wherein the base comprises a series of separate base assemblies, each of which includes a floor mounting member adapted for engagement with the supporting surface and a plurality of upwardly extending slide assembly mounting members, each of which is secured to a fixed portion forming a part of each slide assembly.

21. The extension and retraction mechanism of claim 20, wherein the floor mounting member of each base assembly extends in a direction transverse to the direction of movement of the mounting structure and the article of furniture between its extended and retracted positions, wherein each floor mounting member defines a pair of spaced ends which include engagement structure configured to mate with the engagement structure of a floor mounting member of the base assembly of an adjacent extension and retraction mechanism.

22. An extension and retraction system for a storage member, comprising:

base means adapted to be mounted to a supporting surface;

a plurality of separate, self-contained extendible and retractable slide members, wherein each slide member is detachably mounted to the base means independently of the other slide members, and wherein each slide member includes an inner portion and an extension portion movably mounted to the inner portion, wherein the inner portion of each slide member is fixed to the base means separately from the remainder of the slide members; and mounting means adapted to mount the storage member to the extension portion of each slide member;

wherein the slide members are configured to provide movement of the storage member relative to the base means between an extended position and a retracted position without engagement with the supporting surface during movement of the storage member;

wherein the detachable mounting of each slide member to the base means independently of the other slide members enables the number of slide members to be varied according to the capacity of the storage members, and enables each slide member to be removed from the base means for servicing or replacement independently of the other slide members.

23. The extension and retraction system of claim 22, wherein the base means comprises a series of base members adapted to be secured to the supporting surface, wherein each base member includes mounting structure for mounting the inner portion of one of the slide members separately from the remainder of the slide members.

24. The extension and retraction system of claim 22, wherein the mounting means comprises a rigid frame assembly adapted for securement to the storage member, and a support member mounted to the extension portion of each slide member and interconnected with the rigid frame assembly.

25. The extension and retraction system of claim 22, wherein the rigid frame assembly comprises a pair of spaced transverse cross-members and a pair of support members fixed to and extending between the pair of cross-members.

26. The extension and retraction system of claim 24, including a releasable engagement arrangement adapted to be interposed between the rigid frame assembly and the article of furniture for releasably engaging the article of furniture with the rigid frame assembly.

27. A method of assembling a pull-out mechanism for an article of furniture, comprising the steps of:

providing a mounting structure adapted to be mounted to the article of furniture;

providing a base arrangement adapted to be secured to a supporting surface; and interconnecting a selected number of separate, self-contained substantially identically constructed extendible and retractable slide assemblies between the base arrangement and the mounting structure by detachably mounting each slide assembly to the base arrangement independently of the other slide assemblies, wherein the number of slide assemblies is selected according to the load requirements for the article of furniture, and wherein the slide assemblies provide movement of the mounting structure and the article of furniture between a retracted position located over the base arrangement and an extended position located outwardly of the base arrangement;

whereby the independent detachable mounting of the slide assemblies to the base arrangement enables each slide assembly to be removed from the base arrangement separately from the other slide assemblies.

28. The method of claim 27, wherein the step of providing a base arrangement comprises providing a series of base members, each of which is adapted for separate mounting to the supporting surface, and wherein the step of interconnecting the slide assemblies with the base arrangement comprises securing a fixed inner portion associated with each slide assembly to one of a plurality of mounting areas associated with each base member, wherein each slide assembly is interconnected with the base arrangement separately from the remainder of the slide assemblies.

29. The method of claim 28, further comprising the step of varying the configuration of the base member according to the selected number of slide assemblies to provide the required number of mounting areas for the selected number of slide assemblies.

30. The method of claim 29, wherein the step of varying the configuration of the base member is carried out by providing a floor mounting member and securing a number of slide assembly mounting members to the floor mounting member, wherein the number and configuration of the slide assembly mounting members is selected according to the selected number of slide assemblies.

31. The method of claim 27, wherein the article of furniture is adapted to be secured to the mounting structure by releasably engaging the article of furniture with a rigid frame section forming a part of the mounting structure.

32. The method of claim 31, wherein the step of interconnecting the slide assemblies with the mounting structure comprises securing a support member to an extendible portion associated with each slide assembly, and interconnecting each support member with the rigid frame section.

33. The method of claim 27, wherein the step of providing a base arrangement includes providing a series of separate base members which are adapted to be spaced apart from each other and mounted to the supporting surface, wherein each base member includes a slide assembly mounting area, and wherein the step of interconnecting the slide assemblies with the base arrangement comprises mounting a fixed inner portion of each slide assembly to the slide assembly mounting area of each base member.

* * * * *